US006280535B2

(12) United States Patent
Miyoshi et al.

(10) Patent No.: US 6,280,535 B2
(45) Date of Patent: Aug. 28, 2001

(54) MANUFACTURING PROCESS ON CHROMATE-COATED LEAD-CONTAINING GALVANIZED STEEL SHEET WITH ANTI-BLACK PATINA PROPERTY AND ANTI-WHITE RUST PROPERTY

(75) Inventors: Tatsuya Miyoshi; Takahiro Kubota; Masaru Sagiyama; Yoshiharu Sugimoto; Masaaki Yamashita, all of Tokyo (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/029,574

(22) PCT Filed: Jun. 30, 1997

(86) PCT No.: PCT/JP97/02261

§ 371 Date: Mar. 23, 1998

§ 102(e) Date: Mar. 23, 1998

(87) PCT Pub. No.: WO98/00579

PCT Pub. Date: Jan. 8, 1998

(30) Foreign Application Priority Data

| | | |
|---|---|---|
| Jul. 2, 1996 | (JP) | 8-191364 |
| Jul. 2, 1996 | (JP) | 8-191365 |
| Dec. 27, 1996 | (JP) | 8-357954 |
| Dec. 27, 1996 | (JP) | 8-357955 |

(51) Int. Cl.[7] ..... C23C 22/24

(52) U.S. Cl. ..... 148/264; 148/267; 148/268; 427/321; 427/433

(58) Field of Search ..... 148/264, 267, 148/268, 273, 275, 286; 427/321, 433, 436

(56) References Cited

U.S. PATENT DOCUMENTS

| | | | | |
|---|---|---|---|---|
| 4,029,478 | * | 6/1977 | Lee | 427/433 |
| 5,667,843 | * | 9/1997 | Yoshitake et al. | 148/267 |

FOREIGN PATENT DOCUMENTS

| | | | |
|---|---|---|---|
| 59-177381 | 10/1984 | (JP) . | |
| 61-110777 | 5/1986 | (JP) . | |
| 62-182260 | 8/1987 | (JP) . | |
| 5-33157 | 2/1993 | (JP) . | |
| 5-98407 | 4/1993 | (JP) . | |
| 7-11453 | 1/1995 | (JP) . | |
| 7-54156 | 2/1995 | (JP) . | |
| 92/03594 * | 3/1995 | (WO) | 148/267 |

OTHER PUBLICATIONS

Tetsu & Hagane vol. 77 (1991) pp. 939–946; "Crystal Orientation and Element Distribution of Spangle on Hot–dip Galvanizing Steel".

The 60th Scientific Lecture Meetong of the Associate of Metal Surface Technology, pp. 150–151.

Copy of the International Search Report dated Sep. 30, 1997.

* cited by examiner

*Primary Examiner*—John Sheehan
*Assistant Examiner*—Andrew L. Oltmans
(74) *Attorney, Agent, or Firm*—Nields & Lemack

(57) ABSTRACT

A production method for a lead-containing hot-galvanized chromated steel sheet with excellent resistance to blackening and white rust formation comprises: (a) plating a steel sheet in a hot-galvanizing bath containing 0.05–0.3 wt. % lead and 0.1–0.3 wt. % aluminum; (b) coating this with a chromating solution containing chromium (VI) ions, chromium (III) ions and nitrate ions in which the Cr(III)/Cr(VI) molar ratio is 1/9–1/1 and the nitrate ion to total chromium ion molar ratio is 0.1–1.6; and (c) without washing with water, drying the sheet at 40–250 deg. C., to form a 5–50 mg/m integral 2 (in terms of chromium) chromate film.

8 Claims, No Drawings

MANUFACTURING PROCESS ON CHROMATE-COATED LEAD-CONTAINING GALVANIZED STEEL SHEET WITH ANTI-BLACK PATINA PROPERTY AND ANTI-WHITE RUST PROPERTY

TECHNICAL FIELD

This invention relates to a process for manufacturing a chromate-coated lead-containing galvanized steel sheet having excellent anti-black patina and anti-white rust properties, and more particularly, to a process which is useful for the chromate coating of a lead-containing galvanized steel sheet having beautiful spangles.

BACKGROUND ART

As the galvanizing of steel sheet is the most effective and economical means for protecting it from corrosion by a galvanic action, ten millions of tons of crude steel, which correspond to about 10% of the yearly crude steel production of Japan (about 100 millions of tons), are used for the manufacture of galvanized steel sheets which are used in a wide variety of fields including their use as building materials, and as materials for automobiles and electric appliances. Zinc manifests a galvanic action as described below. The two metals, zinc and iron, contacting each other form a cell in which zinc, which is the baser metal, forms the anode, while iron becomes the cathode. Thus, it restrains any anodic dissolution by a local cell as formed by iron alone, and thereby prevents its corrosion. This rust-preventing action ends upon loss of all of zinc contacting iron, and in order to sustain the action for a long period of time, it is necessary to restrain the corrosion of the zinc layer, and it is, therefore, common practice to coat the zinc layer with chromate.

The chromate coating of galvanized steel sheet has, however, the drawback of having a black patina formed on the sheet during its storage or transport and impairing its appearance seriously, though it may drastically improve its corrosion resistance (anti-white rust property) It is known that a black patina is likely to appear on, among others, galvanized steel sheet subjected to skin pass after galvanizing, or produced in a galvanizing bath containing lead, or coated with a zinc layer containing several percent of aluminum.

The black patina is characterized by a grayish black color presented by spangles formed in a galvanized surface and having a specific crystalline orientation, and it is, therefore, effective to minimize the spangles by a known method to restrain the appearance of a black patina to some extent. It is also known that the use of a galvanizing bath containing only a very small amount of lead (Pb not exceeding 0.01% by weight) makes a black patina less likely to appear, since the spangles in which a black patina appears contain lead particles forming the active sites which promote the appearance of a black patina. The addition of lead to a galvanizing bath is, however, unavoidable, since many users of galvanized steel sheets like spangles.

According to pages 939 to 946 of TETSU & HAGANE, Vol. 77 (1991), published by The Japan Iron and Steel Association, the spangles are classified into seven types, i.e. fern I, fern II, mirror, frost, half fern, feather, and triangle types, and the frost type spangles are particularly likely to be enriched with Pb and Al. The users who like spangles generally prefer a surface having many frost type spangles as presenting a beautiful appearance, but a black patina is particularly likely to appear in frost type spangles, since they are enriched with Pb and Al, as stated above.

Japanese Patent Application Laid-Open No. Sho 59-177381 proposed flashing treatment with an aqueous solution containing Ni or Co ions (for the chemical deposition of a very small amount of metal) as a method of preventing a black patina from appearing after chromate treatment, and the flashing treatment has recently come to be considered as an effective method of preventing a black patina from appearing after chromate treatment. According to the disclosure of Japanese Patent Application Laid-Open No. Sho 59-177381, the surface of a zinc or zinc-alloy plated steel sheet is given flashing treatment with an aqueous solution having a pH of 1 to 4, or 11 to 13, and containing Ni or Co ions, or both prior to its chromate treatment, whereby the metal ions are deposited in metallic or oxide form on the sheet surface, and after it is washed with water, a chromate film is formed thereon.

There is not yet any definite opinion about the mechanism which enables the flashing treatment of a zinc or zinc-alloy plated steel sheet with Ni or Co to prevent a black patina from appearing thereon after its chromate treatment, but according to the statement on pages 150 and 151 of the Preprint for the 60th Scientific Lecture Meeting of the Association of Metal Surface Technology, the metal as deposited by flashing is mostly found in the grain boundary of zinc crystals, and the chromium compound as deposited by the subsequent chromate coating treatment is likewise distributed in the grain boundary, and it can, therefore, be presumed that some interaction occurs between the metal as deposited by flashing and the chromium compound, and causes the latter to be adsorbed and fixed to the former.

The black patina formed on a zinc or zinc-alloy plated steel sheet looks black, apparently because the basic zinc carbonate of which it is composed, and which is represented as $(ZnCO_3)x.[Zn(OH)_2]y$, like white rust, has a particle diameter falling within the visible light wavelength range of 400 to 700 nm, and is, therefore, very likely to scatter and absorb light. The black patina is considered as a product of corrosion formed in an environment lacking oxygen, and particularly with the progress of corrosion from the grain boundary. Accordingly, it is considered that the chromium compound with which the grain boundary is enriched by the metal deposited by flashing restrains the corrosion from the grain boundary and thereby contributes to preventing the formation of a black patina. Thus, the flashing treatment of a zinc or zinc-alloy plated steel sheet with Ni, Co, etc. prior to its chromate treatment can be an effective means for preventing the formation of any black patina thereon.

It has, however, been found that the flashing treatment carried out prior to chromate treatment makes white rust more likely to form, though it may restrain the formation of a black patina. This is apparently due to the fact that Ni or Co as deposited on the galvanized surface by the flashing treatment forms a local cell with zinc.

It is, therefore, an object of this invention to provide a process which can manufacture a chromate-coated lead-containing galvanized steel sheet having excellent anti-black patina and anti-white rust properties without relying upon any flashing treatment with Ni, Co, etc., and more particularly, a chromate-coated lead-containing galvanized steel sheet which hardly has any black patina formed thereon, even if it may have many spangles of the frost type which is liked by many users.

DISCLOSURE OF THE INVENTION

As a result of a wide range of experiments and study which we have made to explore the possibility of improving the anti-black patina and anti-white rust properties of a chromate-coated lead-containing zinc or zinc-alloy plated steel sheet having beautiful spangles, we, the inventors of this invention, have found that it is possible to manufacture a chromate-coated lead-containing galvanized steel sheet having beautiful spangles and yet showing excellent anti-black patina and anti-white rust properties on an industrially steady basis if a lead-containing zinc or zinc-alloy plated steel sheet produced in a galvanizing bath having a specific composition is treated with a chromate coating solution having a specific composition and containing nitrate ions.

We have, moreover, found that it is possible to manufacture a chromate-coated lead-containing galvanized steel sheet having an outstandingly high corrosion resistance by pre-treating the sheet with an aqueous alkali solution before its treatment with the chromate coating solution having a specific composition as mentioned above, or by giving it two steps of treatment consisting of its pre-treatment with the aqueous alkali solution and its treatment with the chromate coating solution having a specific composition and containing nitrate ions.

This invention is based on what we have found as stated above, and its salient features are as follows:

[1] A process for manufacturing a chromate-coated lead-containing galvanized steel sheet having excellent anti-black patina and anti-white rust properties, characterized in that a lead-containing galvanized steel sheet obtained by plating a steel sheet in a galvanizing bath containing 0.05 to 0.3% by weight of Pb and 0.1 to 0.3% by weight of Al is coated with a chromate coating solution containing hexavalent and trivalent chromium ions and nitrate ions in such proportions that the trivalent chromium ions have a molar ratio of 1/9 to 1/1 to the hexavalent chromium ions, while the nitrate ions have a molar ratio of 0.1 to 1.6 to the total of the chromium ions, and that the sheet is dried at a sheet temperature of 40–250° C. without being washed with water, whereby a chromate film having a coating weight of 5 to 50 mg/m$^2$ in terms of metallic chromium is formed thereon.

[2] A process for manufacturing a chromate-coated lead-containing galvanized steel sheet having excellent anti-black patina and anti-white rust properties as set forth at [1] above, wherein the lead-containing galvanized steel sheet is obtained by employing a temperature of 440–500° C. for the galvanizing bath and a temperature of 440–520° C. for the sheet to be immersed into the bath.

[3] A process for manufacturing a chromate-coated lead-containing galvanized steel sheet having excellent anti-black patina and anti-white rust properties as set forth at [1] or [2] above, wherein the chromate coating solution contains one or more kinds of metal ions selected from among cobalt, nickel, strontium and barium ions, and having a total molar ratio of 0.04 to 0.2 to the total of the chromium ions.

[4] A process for manufacturing a chromate-coated lead-containing galvanized steel sheet having excellent anti-black patina and anti-white rust properties as set forth at [1] or [2] above, wherein the chromate coating solution contains cobalt ions having a molar ratio of 0.04 to 0.2 to the total of the chromium ions.

[5] A process for manufacturing a chromate-coated lead-containing galvanized steel sheet having excellent anti-black patina and anti-white rust properties, characterized in that a lead-containing galvanized steel sheet obtained by plating a steel sheet in a galvanizing bath containing 0.05 to 0.3% by weight of Pb and 0.1 to 0.3% by weight of Al is treated with an aqueous alkali solution having a pH of 9 or above, and that after it is washed with water, it is coated with a chromate coating solution containing hexavalent and trivalent chromium ions and nitrate ions in such proportions that the trivalent chromium ions have a molar ratio of 1/9 to 1/1 to the hexavalent chromium ions, while the nitrate ions have a molar ratio of 0.1 to 1.6 to the total of the chromium ions, and that the sheet is dried at a sheet temperature of 40–250° C. without being washed with water, whereby a chromate film having a coating weight of 5 to 50 mg/m$^2$ in terms of metallic chromium is formed thereon.

[6] A process for manufacturing a chromate-coated lead-containing galvanized steel sheet having excellent anti-black patina and anti-white rust properties as set forth at [5] above, wherein the lead-containing galvanized steel sheet is obtained by employing a temperature of 440–500° C. for the galvanizing bath and a temperature of 440–520° C. for the sheet to be immersed into the bath.

[7] A process for manufacturing a chromate-coated lead-containing galvanized steel sheet having excellent anti-black patina and anti-white rust properties as set forth at [5] or [6] above, wherein the chromate coating solution contains one or more kinds of metal ions selected from among cobalt, nickel, strontium and barium ions, and having a total molar ratio of 0.04 to 0.2 to the total of the chromium ions.

[8] A process for manufacturing a chromate-coated lead-containing galvanized steel sheet having excellent anti-black patina and anti-white rust properties as set forth at [5] or [6] above, wherein the chromate coating solution contains cobalt ions having a molar ratio of 0.04 to 0.2 to the total of the chromium ions.

According to this invention, a chromate-coated lead-containing galvanized steel sheet which is excellent in all of its film appearance, and anti-black patina and anti-white rust properties can be manufactured steadily from a lead-containing galvanized steel sheet having beautiful spangles without relying upon any flashing treatment thereof with Ni, Co, etc.

BEST MODE OF CARRYING OUT THE INVENTION

This invention is a process for the chromium coating of a lead-containing galvanized steel sheet obtained by plating in a galvanizing bath containing 0.05 to 0.3% by weight of Pb and 0.1 to 0.3% by weight of Al. The lead and aluminum in the galvanizing film on the lead-containing galvanized steel sheet are the constituents necessary for forming a beautiful pattern of spangles, and improving the adhesion of the film, respectively. The galvanizing film has a surface enriched with such lead and aluminum, but its surface enriched with lead makes the film lack electrochemical uniformity, and thereby promotes the formation of a black patina. The enrichment of the film surface with lead is likely to occur particularly to the surface having frost type spangles as obtained by galvanizing under specific conditions (i.e. a specific temperature of the galvanizing bath and a specific temperature of the steel sheet upon immersion into the bath). The aluminum stays in most of the cases as a stable oxide in the skin of the galvanizing film, but as the aluminum oxide does not easily react with a chromate coating solution, it makes it difficult to form a uniform chromate film and thereby achieve an improved corrosion resistance.

In connection with these problems, we have found that, if a lead-containing galvanized steel sheet is brought into contact with a chromate coating solution containing nitric acid, it is possible to remove lead from its galvanized surface and thereby restrain the formation of a black patina effectively. Although even such chromate treatment may, of course, not be able to remove all of the lead from the galvanized surface, but may allow some lead to remain therein, we have found that such chromate treatment is remarkably effective in restraining the formation of a black patina, and that a chromate film thereby formed provides an improved corrosion resistance, too, since a large amount of chromium covers the surface of active lead remaining in the galvanized surface. The effective removal of the lead enriching the galvanized surface is achieved particularly by the chromate coating solution containing nitric acid, and no satisfactory removal of such lead can be obtained by any chromate coating solution containing any other inorganic acid, such as phosphoric, sulfuric or fluoric acid.

No satisfactory removal of aluminum from the galvanized surface can be achieved by its treatment with any chromate coating solution containing chromic acid and an inorganic acid (e.g. nitric, phosphoric, sulfuric or fluoric acid) as mentioned above. As a result of further study, we have found that the treatment of the galvanized surface with an aqueous alkali solution prior to its chromate treatment makes it possible to remove any aluminum oxide from it and thereby improve its corrosion resistance effectively. We have, thus, ascertained that the lead and aluminum staying in the galvanized surface in an enriching form, which can hardly be removed by any known chromic acid, or partially reduced chromic acid solution, can be removed adequately by two steps of treatment consisting of its pre-treatment with an aqueous alkali solution and its chromate treatment with a chromate coating solution containing nitric acid as mentioned above to thereby improve its anti-black patina property and corrosion resistance effectively.

We have further found that, if the chromate treatment with a chromate coating solution containing nitric acid as stated above is carried out by employing a chromate coating solution containing hexavalent and trivalent chromium ions and nitrate ions, and having a molar nitrate ion ratio of 0.1 to 1.6 to the total of the chromium ions, it is possible to remove lead effectively by a very small amount of etching, and that such a chromate coating solution can be used for a long time without having any sludge formed by the inclusion of zinc, or other impurity ions, but staying stable in composition.

The following is a detailed description of the invention and the reasons for the various limitations employed for defining it.

The lead-containing galvanized steel sheet for which the chromate treatment of this invention is intended is obtained by plating a steel sheet in a galvanizing bath containing 0.05 to 0.3% by weight of Pb and 0.1 to 0.3% by weight of Al, and is particularly likely to present the problem of a black patina, as stated before. If the lead content of the bath is lower than 0.05% by weight, no satisfactorily beautiful form of regular spangles can be produced on the galvanized steel sheet, but if it exceeds 0.3% by weight, it is not only uneconomical, since it cannot be expected to produce any better results, but it also makes the intergranular corrosion of the galvanizing layer likely to occur easily. If the aluminum content of the bath is lower than 0.1% by weight, no satisfactory adhesion of the galvanizing layer can be obtained, but if it exceeds 0.3% by weight, the chromate-coated galvanized surface is undesirably likely to form a black patina when exposed to an environment of high temperature and humidity.

The lead-containing galvanized steel sheet exhibits a particularly beautiful form of regular spangles if it is obtained by employing a galvanizing bath temperature of 440–500° C. and a temperature of 440–520° C. for the sheet to be immersed into the bath. It is, therefore, advisable to use a lead-containing galvanized steel sheet obtained under the conditions as mentioned if the appearance of its regular spangles is of particular importance. If the galvanizing bath temperature is lower than 440° C., no beautiful form of regular spangles can be obtained, but if it exceeds 500° C., the alloying of iron and zinc proceeds to an undesirable extent. If the temperature of the sheet to be immersed in the bath is lower than 440° C., no beautiful form of regular spangles can be obtained, but if it exceeds 520° C., it is not only impossible to obtain any beautiful form of regular spangles, but also the galvanizing layer shows an undesirably low adhesion. The preferred galvanizing conditions include a galvanizing bath temperature of 450– 480° C. and a sheet immersion temperature of 450–490° C., and make it possible to obtain a particularly beautiful form of spangles.

While the process of this invention includes the chromate treatment of the lead-containing galvanized steel sheet which is carried out by treating it with the chromate coating solution having a specific composition as described above, it is preferable to pre-treat the sheet with an aqueous alkali solution having a pH of 9 or above, and more preferably a pH of 9 to 12, in order to remove aluminum from the galvanized surface.

If the aqueous alkali solution used for the pre-treatment has a pH below 9, the galvanized surface hardly has its aluminum oxide dissolved, but has a lower reactivity with the chromate coating solution, and thereby a lower corrosion resistance. If it has a pH of over 12, an excessively large amount of zinc is etched, and the chromate coating solution has a lower level of stability. If such pre-treatment is employed, the galvanized steel sheet is washed with water prior to its chromate treatment.

Its chromate treatment is carried out for coating it with a chromate film formed from a chromate coating solution containing hexavalent and trivalent chromium ions and nitrate ions, and having a molar ratio of trivalent to hexavalent chromium ions and a molar ratio of nitrate to total chromium ions which have both been controlled within appropriate ranges.

The trivalent and hexavalent chromium ions in the chromate coating solution have a molar ratio of from 1/9 to 1/1, and preferably from 1/4 to 2/3 (trivalent/hexavalent). If the molar ratio of the trivalent/hexavalent chromium ions is smaller than 1/9, the dissolution of chromium in a corrosive environment is too excessive to sustain corrosion resistance for a long time, and is also undesirable, as it brings about environmental pollution. If their molar ratio exceeds 1/1, no satisfactorily improved corrosion resistance can be expected from hexavalent chromium ions.

Referring to the mechanism which enables a chromate film to prevent white rust, it is generally understood that hexavalent chromium ions have an inhibitive effect for restraining the corrosion of zinc, and it is also considered that its self-healing effect exhibited by the hexavalent chromium ions eluted from the chromate film and healing any damaged part thereof contributes to providing an improved anti-white rust property. If a chromate film is formed from a solution containing only hexavalent chromium ions, however, the excessive elution of hexavalent chromium ions in the presence of water causes white rust to form, and it is, therefore, common practice to add trivalent chromium ions in order to prevent the excessive elution of hexavalent chromium ions. For the same purpose, this invention also employs a chromate coating solution containing trivalent and hexavalent chromium ions in the molar ratio as mentioned before.

It is generally necessary for an aqueous solution containing only trivalent and hexavalent chromium ions to have a molar ratio of trivalent/hexavalent chromium ions not exceeding 2/3, so that the trivalent chromium ions may not settle, but may remain as ions in the solution. The color tone of its surface is often considered as an important feature of a lead-containing galvanized steel sheet having a beautiful pattern of spangles, and as the presence of a large amount of chromium coating produces a yellowish color having an adverse effect on its color tone, there is no alternative but to restrict the amount of chromium coating even at some sacrifice of corrosion resistance. The chromate coating solution employed for the purpose of this invention, however, makes it possible to prevent any such undesirable coloring without having the amount of chromium coating reduced, since it contains nitric acid as an acid constituent other than chromic acid, and has, therefore, a smaller proportion of hexavalent chromium ions having an adverse effect on the color tone of the galvanized surface, and thereby a molar ratio of trivalent/hexavalent chromium ions which is higher than 2/3 (but not higher than 1/1, as stated before).

An aqueous solution of chromic anhydride which has been partially reduced by a known reducing agent can be used as a source of chromium ions for the chromate coating solution, while chromium nitrate can be used as a source of trivalent chromium ions.

The nitrate ions in the chromate coating solution have a molar ratio of from 0.1 to 1.6, and preferably from 0.4 to 1.2, to the total chromium ions. If their molar ratio is smaller than 0.1, no satisfactory result can be obtained in restraining any black patina, and if it exceeds 1.6, the chromate coating solution has so high an etching force that a sludge is formed by the inclusion of impurity ions, such as Zn and Al, and makes it impossible to form a layer having a constantly high corrosion resistance.

Nitric acid, chromium nitrate, cobalt nitrate, or zinc nitrate can, for example, be used as a source of nitrate ions for the chromate coating solution.

The chromate coating solution may further contain one or more kinds of metal ions selected from among cobalt, nickel, strontium and barium ions, and having a molar ratio of 0.04 to 0.2 to the total chromium ions. These metal ions and chromate ions form an insoluble compound which is believed to improve the barrier property of the chromate film and thereby the corrosion resistance of the steel. If their molar ratio is smaller than 0.04, hardly any improved corrosion resistance can be obtained, while if it exceeds 0.2, the chromate coating solution easily forms a sediment and becomes lower in stability.

The chromate coating solution is likely to contain Zn, Al, Pb, or other metal ions as unavoidable inclusions by its etching action from the galvanizing layer, but they do not adversely affect the advantages of this invention.

While several kinds of metal ions have been mentioned, the most remarkably improved anti-white rust property can be obtained when cobalt ions are added. We have experimentally compared a chromate film formed from a chromate coating solution containing cobalt ions with a chromate film formed from a solution not containing cobalt ions, and found that the former contains a larger amount of hexavalent chromium in its outermost layer than the latter does, though they are substantially equal in their hexavalent chromium content. It is, therefore, obvious that the chromate film containing cobalt ions exhibits a greater self-healing effect owing to the hexavalent chromium ions than the chromate film not containing cobalt ions does, and thereby a remarkably improved anti-white rust property. Thus, the cobalt ions are the most preferable metal ions to be added to the chromate coating solution.

A basic carbonate, carbonate, or nitrate of a metal can, for example, be used as a source of its ions for the chromate coating solution.

The chromate coating solution may further contain a silica gel, fumed silica, or other colloidal silica, an aqueous resin, etc., as required.

After the chromate coating solution has been coated on the surface of the galvanized steel sheet, it is not washed with water, but is dried until a maximum sheet temperature of 40–250° C. is reached. If the sheet temperature is lower than 40° C., the remaining water makes an easily dissolvable chromate film, and if it exceeds 250° C., the hexavalent chromium ions which are effective for corrosion resistance are reduced to trivalent chromium ions, and a chromate film formed as a high molecule becomes a low molecule, resulting in an undesirable lowering of corrosion resistance.

The chromate film as formed by coating and drying has a coating weight of from 5 to 50 mg/m$^2$, and preferably from 10 to 30 mg/m$^2$, in terms of metallic chromium. If its coating weight is less than 5 mg/m$^2$ in terms of metallic chromium, no satisfactorily high corrosion resistance can be obtained, while if it exceeds 50 mg/m$^2$, the film is distinctly colored and damages the beautiful surface appearance of the lead-containing galvanized steel sheet.

Any known method, such as spray or dip coating followed by roll or air squeezing, or roll coating, can be employed for coating the galvanized surface with the chromate coating solution.

EXAMPLES

Chromate treatment was given to lead-containing galvanized steel sheets as shown at (A) to (D) below after a part of them had been pre-treated with an aqueous alkali solution, while no such pre-treatment had been given to the rest thereof. The pre-treatment was carried out under the conditions as stated at (a) or (b) below, and was followed by washing with a spray of tap water (continued for 10 seconds), and air drying. The chromate treatment was carried out by roll coating the sheets with chromate coating solutions having the compositions shown in Tables 1 to 5 (and basing the control of the chromium coating weight on wet weight), and drying them in a hot-air drying furnace having a temperature of 300° C. and an air flow rate of 2 m/sec. until a maximum sheet temperature of 40–270° C. was reached, whereby chromate-coated lead-containing galvanized steel sheets were prepared as samples.

The samples were evaluated for their galvanized surface appearance, film appearance, anti-black patina property, and corrosion resistance (anti-white rust property). The evaluation was made of both of samples as obtained soon after chromate treatment had been started, and samples as obtained after the progress of chromate treatment to some extent (i.e. after the continuous treatment of 20 m$^2$ of samples with one liter of coating solution), and by treatment with the solution containing dissolved zinc, as far as the products of this invention were concerned, while two such kinds of samples were evaluated only partly, as far as the comparative cases were concerned. The results are shown in Tables 1 to 5 with the composition of the chromate coating solution, the chromium coating weight, etc.

[Lead-containing Galvanized Steel Sheet]

(A) A regular-spangled sheet made by dipping a sheet having a temperature of 480° C. in a galvanizing bath containing 0.2% Al and 0.1% Pb, both by weight, and having a temperature of 470° C. (and having a coating weight of 90 g/m$^2$);

(B) A regular-spangled sheet made by dipping a sheet having a temperature of 440° C. in a galvanizing bath containing 0.2% Al and 0.1% Pb, both by weight, and having a temperature of 440° C. (and having a coating weight of 90 g/m$^2$);

(C) A regular-spangled sheet made by dipping a sheet having a temperature of 530° C. in a galvanizing bath containing 0.2% Al and 0.1% Pb, both by weight, and having a temperature of 510° C. (and having a coating weight of 90 g/m$^2$); and (D) A regular-spangled sheet made by dipping a sheet having a temperature of 430° C. in a galvanizing bath containing 0.2% Al and 0.1% Pb, both by weight, and having a temperature of 430° C. (and having a coating weight of 90 g/m$^2$).

[Conditions of Pre-treatment With an Aqueous Alkali Solution]

(a) Pre-treatment with an aqueous alkali solution having a pH of 9 (spraying at a temperature of 60° C. for 30 seconds); and (b) Pre-treatment with an aqueous alkali solution having a pH of 13 (spraying at a temperature of 50° C. for 3 seconds).

[Evaluation for Properties]

(1) Appearance of Galvanized Surface (of Spangles)

The spangles formed on the galvanized surface were visually examined to determine the ratio by area of the frost type spangles, and the galvanized surface was evaluated for its appearance in accordance with the following criteria:

◎: The ratio by area is 60% or more;

○: From 40%, inclusive, to 60%, exclusive;

Δ: From 20%, inclusive, to 40%, exclusive;

×: Less than 20%.

(2) Appearance of Film

The value of *b between a sample and an untreated material (b value of sample—b value of untreated material) was determined by a color difference meter, and the film was evaluated for its appearance in accordance with the following criteria:

◎: Δb is less than 1;

○: Δb is from 1, inclusive, to 3, exclusive;

Δ: Δb is from 3, inclusive, to 5, exclusive;

×: Δb is 5 or more.

(3) Anti-black Patina Property

A plurality of testpieces each measuring 70 mm by 150 mm were cut out from each sample, and 5 to 10 pairs of testpieces so prepared that the surfaces to be tested of the testpieces in each pair might face each other, were laid one pair upon another, and packed in a sheet of vinyl-coated paper. Each package was held between two stainless steel sheets each having a thickness of 10 mm and carrying an acrylic sheet bonded to its inner surface, and after the stainless steel sheets had been fastened together by bolts at their four corners, a load of 0.67 kgf·cm$^2$ was applied to each package in a humidity test cabinet having a temperature of 50° C. and a relative humidity of 95%, and after 240 hours, it was removed from the cabinet and each testpiece was visually inspected for any black patina on its surface to be tested. The criteria for evaluatio n were as follows:

◎: No black patina was found;

○: A very light gray color was recognized;

Δ: A black patina was found;

×: A serious black patina was found.

(4) Corrosion Resistance

A plurality of testpieces each measuring 70 mm by 150 mm were cut out from each sample, and a salt spray test conforming to JIS Z 2371 was conducted on each testpiece, and each testpiece was visually examined for the area covered by white rust after 96 and 120 hours if it was of any sample prepared without any pre-treatment, or after 120 and 200 hours if it was of any sample prepared after pre-treatment. The criteria for evaluation were as follows:

◎: No white rust was found;

○: White rust was found in an area of less than 5%;

Δ: White rust was found in an area of from 5%, inclusive, to 25%, exclusive;

×: White rust was found in an area of 25% or more.

Tables 1 to 5 confirm that the chromate-coated lead-containing galvanized steel sheets manufactured by the process of this invention has a galvanized surface with beautiful spangles, and a chromate film appearance, and anti-black patina and anti-white rust properties which are all excellent. The samples according to this invention also confirm that the restrained etching effect on galvanized steel sheets makes the process highly suitable for continuous operation. On the other hand, the comparative samples are inferior in any of galvanized surface, or chromate film appearance, and anti-black patina and anti-white rust properties.

TABLE 1

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 1a | A | Not given | 1/4 | 0.8 | — | — | 0 | 60 | 15 | ◎ | ◎ | ◎ | ◎/○ | I |
| 1b | A | Not given | 1/4 | 0.8 | — | — | 0.4 | 60 | 17 | ◎ | ◎ | ◎ | ◎/○ | I |
| 2a | B | Not given | 1/4 | 0.8 | — | — | 0 | 60 | 16 | ○ | ◎ | ◎ | ◎/○ | I |
| 2b | B | Not given | 1/4 | 0.8 | — | — | 0.4 | 60 | 15 | ○ | ◎ | ◎ | ◎/○ | I |
| 3a | C | Not given | 1/4 | 0.8 | — | — | 0 | 60 | 16 | x | ◎ | ◎ | ◎/○ | I |
| 3b | C | Not given | 1/4 | 0.8 | — | — | 0.4 | 60 | 14 | x | ◎ | ◎ | ◎/○ | I |
| 4a | D | Not given | 1/4 | 0.8 | — | — | 0 | 60 | 16 | Δ | ◎ | ◎ | ◎/○ | I |
| 4b | D | Not given | 1/4 | 0.8 | — | — | 0.4 | 60 | 18 | Δ | ◎ | ◎ | ◎/○ | I |
| 5a | A | Not given | 1/4 | 0.8 | Co:0.04 | — | 0 | 60 | 17 | ◎ | ◎ | ◎ | ◎/◎ | I |
| 5b | A | Not given | 1/4 | 0.8 | Co:0.04 | — | 0.4 | 60 | 15 | ◎ | ◎ | ◎ | ◎/◎ | I |
| 6a | A | Not given | 1/1 | 1.6 | Co:0.20 | — | 0 | 150 | 47 | ◎ | ○ | ◎ | ◎/◎ | I |
| 6b | A | Not given | 1/1 | 1.6 | Co:0.20 | — | 0.8 | 150 | 49 | ◎ | ○ | ◎ | ◎/◎ | I |

TABLE 1-continued

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 7a | A | Not given | 1/2 | 1.1 | Co:0.10 | — | 0 | 80 | 20 | ◎ | ◎ | ◎ | ◎/◎ | I |
| 7b | A | Not given | 1/2 | 1.1 | Co:0.10 | — | 0.6 | 80 | 18 | ◎ | ◎ | ◎ | ◎/◎ | I |
| 8a | A | Not given | 1/9 | 0.1 | Ni:0.06 | — | 0 | 100 | 21 | ◎ | ◎ | ◎ | ◎/○ | I |
| 8b | A | Not given | 1/9 | 0.1 | Ni:0.06 | — | 0.8 | 100 | 22 | ◎ | ◎ | ◎ | ◎/○ | I |
| 9a | A | Not given | 1/5 | 1.0 | Co:0.10 | — | 0 | 80 | 8 | ◎ | ◎ | ◎ | ◎/○ | I |
| 9b | A | Not given | 1/5 | 1.0 | Co:0.10 | — | 0.6 | 80 | 9 | ◎ | ◎ | ◎ | ◎/○ | \| |

*1 Lead-containing galvanized steel sheet as set forth at any of (A) to (D) above in the specification
*2 Conditions of pre-treatment as set forth at (a) or (b) above
*3 Molar ratio
*4 Coating weight in terms of metallic chromium ($mg/m^2$)
*5 96 hours/120 hours
*6 Sample of the invention; C : Comparative sample
[1]: Steel sheet
[2]: Pre-treatment
[3]: Composition of chromate coating solution
[4]: Metal ion
[5]: Others
[5]: Sheet temp. for drying
[7]: Cr coating weight
[8]: Galvanized surface appearance
[1]: Film appearance
[10]: Anti-black patina property
[11]: Anti-white rust property
[12]: Division

TABLE 2

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 10a | A | Not given | 1/5 | 1.0 | St:0.10 | — | 0 | 80 | 25 | ◎ | ◎ | ◎ | ◎/○ | I |
| 10b | A | Not given | 1/5 | 1.0 | St:0.10 | — | 0.4 | 80 | 22 | ◎ | ◎ | ◎ | ◎/○ | I |
| 11a | A | Not given | 1/5 | 1.0 | Ba:0.10 | — | 0 | 80 | 15 | ◎ | ◎ | ◎ | ◎/○ | I |
| 11b | A | Nat given | 1/5 | 1.0 | Ba:0.10 | | 0.3 | 80 | 17 | ◎ | ◎ | ◎ | ◎/○ | I |
| 12a | A | Not given | 1/8 | 0.2 | Co:0.05 | $SiO_2$:4 *7 | 0 | 60 | 20 | ◎ | ◎ | ◎ | ◎/○ | I |
| 12b | A | Not given | 1/8 | 0.2 | Co:0.05 | $SiO_2$:4 *] | 0.2 | 60 | 22 | ◎ | ◎ | ◎ | ◎/○ | I |
| 13a | A | Not given | 1/4 | 0.8 | Co:0.08 | resin:5 *8 | 0 | 230 | 32 | ◎ | ◎ | ◎ | ◎/◎ | I |
| 13b | A | Not given | 1/4 | 0.8 | Co:0.08 | resin:5 *8 | 0.4 | 230 | 31 | ◎ | ◎ | ◎ | ◎/◎ | I |
| 14 | A | Not given | 1/19 | 0.8 | Co:0.05 | — | 0 | 40 | 19 | ◎ | ◎ | ○ | x/x | C |
| 15 | A | Not given | 1/4 | — | — | — | 0 | 60 | 25 | ◎ | ○ | x | x/x | C |
| 16a | A | Not given | 1/1 | 2.0 | Co:0.05 | — | 0 | 150 | 30 | ◎ | ◎ | ◎ | x/x | C |
| 16b | A | Not given | 1/1 | 2.0 | Co:0.05 | — | 3.5 | 150 | 28 | ◎ | ◎ | ◎ | x/x | C |
| 17 | A | Not given | 1/3 | 0.4 | Co:0.05 | — | 0 | 270 | 20 | ◎ | ○ | ◎ | x/x | C |
| 18 | A | Not given | 1/2 | — | Co:0.10 | $PO_4^{3-}$:0.3 *9 | 0 | 80 | 18 | ◎ | ◎ | x | ◎/◎ | C |
| 19 | A | Not given | 1/2 | — | Co:0.10 | $SO_4^{2-}$:0.3 *9 | 0 | 80 | 48 | ◎ | x | x | ◎/◎ | C |
| 20 | A | Not given | 1/2 | — | Co:0.05 | $F^-$:0.2 *9 | 0 | 80 | 30 | ◎ | ○ | x | ◎/◎ | C |
| 21 | A | Not given | 1/1 | 2.0 | Co:0.05 | — | 0 | 80 | 72 | ◎ | Δ | ◎ | Δ/◎ | C |

*1 Lead-containing galvanized steel sheet as set forth at any of (A) to (D) above in the specification
*2 Conditions of pre-treatment as set forth at (a) or (b) above
*3 Molar ratio
*4 Coating weight in terms of metallic chromium ($mg/m^2$)
*5 96 hours/120 hours
*6 I: Sample of the invention; C: Comparative sample
*7 Weight ratio of $SiO_2$ (colloidal silica)/total Cr ions
*8 Weight ratio of acrylic emulsion (solid resin content)/total Cr ions
*9 Molar ratio to total Cr ions
[1]: Steel sheet
[2]: Pre-treatment
[3]: Composition of chromate coating solution
[4]: Metal ion
[5]: Others
[6]: Sheet temp. for drying
[7]: Cr coating weight
[8]: Galvanized surface appearance
[9]: Film appearance
[10]: Anti-black patina property
[11]: Anti-white rust property
[12]: Division

TABLE 3

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 22a | A | a | 1/4 | 0.8 | — | — | 0 | 40 | 18 | ◎ | ◎ | ◎ | ○/○ | I |
| 22b | A | a | 1/4 | 0.8 | — | — | 0.3 | 40 | 17 | ◎ | ◎ | ◎ | ○/○ | I |
| 23a | B | a | 1/4 | 0.8 | — | — | 0 | 40 | 19 | ○ | ◎ | ◎ | ○/○ | I |
| 23b | B | a | 1/4 | 0.8 | — | — | 0.3 | 40 | 17 | ○ | ◎ | ◎ | ○/○ | I |
| 24a | C | a | 1/4 | 0.8 | — | — | 0 | 40 | 20 | x | ◎ | ◎ | ○/○ | I |
| 24b | C | a | 1/4 | 0.8 | — | — | 0.3 | 40 | 18 | x | ◎ | ◎ | ○/○ | I |
| 25a | D | a | 1/4 | 0.8 | — | — | 0 | 40 | 19 | Δ | ◎ | ◎ | ○/○ | I |
| 25b | D | a | 1/4 | 0.8 | — | — | 0.3 | 40 | 20 | Δ | ◎ | ◎ | ○/○ | I |
| 26a | A | a | 1/4 | 0.8 | Ca:0.04 | — | 0 | 60 | 21 | ◎ | ◎ | ◎ | ◎/◎ | I |
| 26b | A | a | 1/4 | 0.8 | Co:0.04 | — | 0.4 | 50 | 19 | ◎ | ◎ | ◎ | ◎/◎ | I |
| 27a | A | a | 1/1 | 1.6 | Co:0.20 | — | 0 | 150 | 32 | ◎ | ◎ | ◎ | ◎/◎ | I |
| 27b | A | a | 1/1 | 1.6 | Co:0.20 | — | 0.8 | 150 | 35 | ◎ | ◎ | ◎ | ◎/◎ | I |

*1 Lead-containing galvanized steel sheet as set forth at any of (A) to (D) above in the specification
*2 Conditions of pre-treatment as set forth at (a) or (b) above
*3 Molar ratio
*4 Coating weight in terms of metallic chromium ($mg/m^2$)
*5 120 hours/200 hours
*6 I: Sample of the invention; C: Comparative sample
*7 Weight ratio of $SiO_2$ (colloidal silica)/total Cr ions
[1]: Steel sheet
[2]: Pre-treatment
[3]: Composition of chromate coating solution
[4]: Metal ion
[5]: Others
[6]: Sheet temp. for drying
[7]: Cr coating weight
[8]: Galvanized surface appearance
[9]: Film appearance
[10]: Anti-black patina property
[11]: Anti-white rust property
[12]: Division

TABLE 4

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 28a | A | a | 1/2 | 1.1 | Co:0.10 | — | 0 | 80 | 18 | ◎ | ◎ | ◎ | ◎/◎ | I |
| 28b | A | a | 1/2 | 1.1 | Co:0.10 | — | 0.5 | 80 | 19 | ◎ | ◎ | ◎ | ◎/◎ | I |
| 29a | A | a | 1/9 | 0.1 | Ni:0.06 | — | 0 | 100 | 20 | ◎ | ◎ | ◎ | ◎/○ | I |
| 29b | A | a | 1/9 | 0.1 | Ni:0.06 | — | 0.8 | 100 | 22 | ◎ | ◎ | ◎ | ◎/○ | I |
| 30a | A | a | 1/5 | 1.0 | Co:0.10 | — | 0 | 80 | 8 | ◎ | ◎ | ◎ | ◎/○ | I |
| 3b | A | a | 1/5 | 1.0 | Co:0.10 | — | 0.6 | 80 | 9 | ◎ | ◎ | ◎ | ◎/○ | I |
| 31a | A | a | 1/5 | 1.0 | Sr:0.10 | — | 0 | 80 | 22 | ◎ | ◎ | ◎ | ◎/○ | I |
| 31b | A | a | 1/5 | 1.0 | Sr:0.10 | — | 0.6 | 80 | 21 | ◎ | ◎ | ◎ | ◎/○ | I |
| 32a | A | a | 1/5 | 1.0 | Ba:0.10 | — | 0 | 80 | 16 | ◎ | ◎ | ◎ | ◎/○ | I |
| 32b | A | a | 1/5 | 1.0 | Ba:0.10 | — | 0.6 | 80 | 19 | ◎ | ◎ | ◎ | ◎/○ | I |
| 33a | A | a | 1/8 | 0.2 | Co:0.05 | $SiO_2$:4 *7 | 0 | 60 | 10 | ◎ | ◎ | ◎ | ◎/○ | I |
| 33b | A | a | 1/8 | 0.2 | Co:0.05 | $SiO_2$:4 *7 | 0.2 | 60 | 11 | ◎ | ◎ | ◎ | ◎/○ | I |

*1 Lead-containing galvanized steel sheet as set forth at any of (A) to (D) above in the specification
*2 Conditions of pre-treatment as set forth at (a) or (b) above
*3 Molar ratio
*4 Coating weight in terms of metallic chromium ($mg/m^2$)
*5 120 hours/200 hours
*6 I: Sample of the invention; C: Comparative sample
*7 Weight ratio of $SiO_2$ (colloidal silica)/total Cr ions
[1]: Steel sheet
[2]: Pre-treatment
[3]: Composition of chromate coating solution
[4]: Metal ion
[5]: Others
[6]: Sheet temp. for drying
[7]: Cr coating weight
[8]: Galvanized surface appearance
[9]: Film appearance
[10]: Anti-black patina property
[11]: Anti-white rust property
[12]: Division

TABLE 5

| No. | [1] *1 | [2] *2 | [3] $Cr^{3+}/Cr^{6+}$ *3 | [3] $NO^{3-}$/T-Cr *3 | [4] /T-Cr *3 | [5] | $Zn^{2+}$ (g/l) | [6] (° C.) | [7] *4 | [8] | [9] | [10] | [11] *5 | [12] *6 |
|---|---|---|---|---|---|---|---|---|---|---|---|---|---|---|
| 34a | A | a | 1/4 | 0.8 | Co:0.08 | resin:5 *8 | 0 | 230 | 41 | ◎ | ◎ | ◎ | ◎/◎ | I |
| 34b | A | a | 1/4 | 0.8 | Co:0.08 | resin:5 *8 | 0.4 | 230 | 42 | ◎ | ◎ | ◎ | ◎/◎ | I |
| 35 | A | a | 1/19 | 0.8 | Co:0.05 | — | 0 | 40 | 21 | ◎ | ○ | ○ | x/x | C |
| 36 | A | a | 1/4 | — | — | — | 0 | 60 | 24 | ◎ | ○ | x | x/x | C |
| 37a | A | b | 1/1 | 2.0 | Co:0.05 | — | 0 | 150 | 29 | ◎ | ◎ | ◎ | x/x | C |
| 37b | A | b | 1/1 | 2.0 | Co:0.05 | — | 3.5 | 150 | 27 | ◎ | ◎ | ◎ | x/x | C |
| 38 | A | a | 1/3 | 0.4 | Co:0.08 | — | 0 | 270 | 20 | ◎ | ○ | ◎ | x/x | C |
| 39 | A | a | 1/2 | — | Co:0.10 | $PO_4^{3-}$:0.3 *9 | 0 | 80 | 18 | ◎ | ◎ | x | ◎/○ | C |
| 40 | A | a | 1/2 | — | Co:0.10 | $SO_4^{2-}$:0.3 *9 | 0 | 80 | 48 | ◎ | x | x | ◎/○ | C |
| 41 | A | a | 1/2 | — | Co:0.05 | $F^-$:0.2 *9 | 0 | 80 | 30 | ◎ | ○ | x | ◎/○ | C |
| 42 | A | a | 1/1 | 2.0 | Co:0.05 | — | 0 | 80 | 72 | ◎ | Δ | ◎ | ◎/Δ | C |

*1 Lead-containing galvanized steel sheet as set forth at any of (A) to (D) above in the specification
*2 Conditions of pre-treatment as set forth at (a) or (b) above
*3 Molar ratio
*4 Coating weight in terms of metallic chromium ($mg/m^2$)
*5 120 hours/200 hours
*6 I: Sample of the invention; C: Comparative sample
*7 Weight ratio of $SiO_2$ (colloidal silica)/total Cr ions
*8 Weight ratio of acrylic emulsion (solid resin content)/total Cr ions
*9 Molar ratio to total Cr ions
[1]: Steel sheet
[2]: Pre-treatment
[3]: Composition of chromate coating solution
[4]: Metal ion
[5]: Others
[6]: Sheet temp. for drying
[7]: Cr coating weight
[8]: Galvanized surface appearance
[9]: Film appearance
[10]: Anti-black patina property
[11]: Anti-white rust property
[12]: Division

INDUSTRIAL UTILITY

This invention enables the manufacture of chromate-coated lead-containing galvanized steel sheets which are suitable as building materials, or materials for electric appliances.

What is claimed is:

1. A process for manufacturing a chromate-coated galvanized steel sheet with a lead-containing coated film having excellent anti-black patina and anti-white rust properties, characterized in that a galvanized steel sheet with a lead-containing coated film obtained by plating a steel sheet in a galvanizing bath containing 0.05 to 0.3% by weight of Pb and 0.1 to 0.3% by weight of Al is coated with a chromate coating solution consisting essentially of hexavalent chromium ions, trivalent chromium ions, nitrate ions and water in such proportions that the trivalent chromium ions have a molar ratio of 1/9 to 1/1 to the hexavalent chromium ions, while the nitrate ions have a molar ratio of 0.1 to 1.6 to the total of the chromium ions, and that the sheet is dried at a sheet temperature of 40–250° C. without being washed with water, whereby a chromate film having a coating weight of 5 to 50 $mg/m^2$ in terms of metallic chromium is formed thereon, and that at least a portion of lead enriching the surface of the coated film is removed in the step of coating the sheet with the chromate coating solution.

2. A process for manufacturing a chromate-coated galvanized steel sheet with a lead-containing coated film having excellent anti-black patina and anti-white rust properties as set forth in claim 1, wherein the galvanized steel sheet with a lead-containing coated film is obtained by employing a temperature of 440–500° C. for the galvanizing bath and a temperature of 440–520° C. for the sheet to be immersed into the bath.

3. A process for manufacturing a chromate-coated galvanized steel sheet with a lead-containing coated film having excellent anti-black patina and anti-white rust properties as set forth in claim 1 or 2, wherein the chromate coating solution contains one or more kinds of metal ions selected from among cobalt, nickel, strontium and barium ions, and having a total molar ratio of 0.04 to 0.2 to the total of the chromium ions.

4. A process for manufacturing a chromate-coated galvanized steel sheet with a lead-containing coated film having excellent anti-black patina and anti-white rust properties as set forth in claim 1 or 2, wherein the chromate coating solution contains cobalt ions having a total molar ratio of 0.04 to 0.2 to the total of the chromium ions.

5. A process for manufacturing a chromate-coated galvanized steel sheet with a lead-containing coated film having excellent anti-black patina and anti-white rust properties, characterized in that a galvanized steel sheet with a lead-containing coated film obtained by plating a steel sheet in a galvanizing bath containing 0.05 to 0.3% by weight of Pb and 0.1 to 0.3% by weight of Al is treated with an aqueous alkali solution having a pH of 9 or above, and that after it is washed with water, it is coated with a chromate coating solution consisting essentially of hexavalent chromium ions, trivalent chromium ions, nitrate ions and water in such proportions that the trivalent chromium ions have a molar ratio of 1/9 to 1/1 to the hexavalent chromium ions, while the nitrate ions have a molar ratio of 0.1 to 1.6 to the total of the chromium ions, and that the sheet is dried at a sheet temperature of 40–250° C. without being washed with water, whereby a chromate film having a coating weight of 5 to 50 $mg/m^2$ in terms of metallic chromium is formed thereon, and that least a portion of lead and aluminum enriching the surface of the coated film are removed in the step of treating the sheet with the aqueous alkali solution and in the step of coating the sheet with the chromate coating solution.

6. A process for manufacturing a chromate-coated galvanized steel sheet with a lead-containing coated film having excellent anti-black patina and anti-white rust properties as set forth in claim 5, wherein the galvanized steel sheet with a lead-containing coated film is obtained by employing a temperature of 440–500° C. for the galvanizing bath and a temperature of 440–520° C. for the sheet to be immersed into the bath.

7. A process for manufacturing a chromate-coated galvanized steel sheet with a lead-containing coated film having excellent anti-black patina and anti-white rust properties as set forth in claim 5 or 6, wherein the chromate coating solution contains one or more kinds of metal ions selected from among cobalt, nickel, strontium and barium ions, and having a total molar ratio of 0.04 to 0.2 to the total of the chromium ions.

8. A process for manufacturing a chromate-coated galvanized steel sheet with a lead-containing coated film having excellent anti-black patina and anti-white rust properties as set forth in claim 5 or 6, wherein the chromate coating solution contains cobalt ions having a total molar ratio of 0.04 to 0.2 to the total of the chromium ions.

* * * * *